United States Patent [19]

Quast

[11] 3,948,032

[45] Apr. 6, 1976

[54] ANTI-FRICTION BALLOON RESTRAINER IN A TEXTILE YARN PROCESSING MACHINE

[75] Inventor: Christoph Quast, Moers, Germany

[73] Assignee: Palitex Project-Company G.m.b.H., Dusseldorf, Germany

[22] Filed: Oct. 17, 1974

[21] Appl. No.: 515,442

[30] Foreign Application Priority Data

Oct. 17, 1973 Germany ..... 2351974

[52] U.S. Cl. ..... 57/108

[51] Int. Cl.[2] ..... D01H 1/42; D01H 13/04

[58] Field of Search ..... 57/108, 58.83, 106

[56] References Cited

UNITED STATES PATENTS

| | | | |
|---|---|---|---|
| 3,065,592 | 11/1962 | Kresslein | 57/108 |
| 3,374,618 | 3/1968 | Franzen | 57/56 |

FOREIGN PATENTS OR APPLICATIONS

| | | | |
|---|---|---|---|
| 627,933 | 10/1962 | France | 57/108 |
| 1,266,673 | 4/1968 | Germany | 57/108 |
| 1,560,261 | 11/1970 | Germany | 57/108 |
| 981,761 | 1/1965 | United Kingdom | 57/108 |
| 1,012,829 | 12/1965 | United Kingdom | 57/108 |
| 1,013,067 | 12/1965 | United Kingdom | 57/108 |

*Primary Examiner*—Donald E. Watkins
*Attorney, Agent, or Firm*—Bell, Seltzer, Park & Gibson

[57] ABSTRACT

A textile yarn processing machine, such as a twister, spinning frame or the like, having spindle assembly stations for the processing of yarn and each including a spindle assembly for carrying a package of yarn to be withdrawn and processed and which produces a rotating balloon of the yarn around the package as it is withdrawn therefrom, and a hollow balloon restrainer device having an inside wall surrounding the package of yarn and the balloon of yarn produced for contact by the rotating balloon of yarn to limit the size thereof during such yarn processing, is provided having the following improvement. Anti-friction means forms at least a portion of the inside wall of the balloon restrainer device, preferably a plastic based sinter material, for providing a reduced coefficient of friction surface for contact by the rotating balloon of yarn processing for reducing friction damage to the yarn being processed.

6 Claims, 4 Drawing Figures

ANTI-FRICTION BALLOON RESTRAINER IN A TEXTILE YARN PROCESSING MACHINE

BACKGROUND OF INVENTION

This invention relates to the improvement of an anti-friction means forming at least a portion of the inside wall of a balloon restrainer device in a textile yarn processing machine for providing a reduced coefficient of friction surface for contact by a rotating balloon of yarn during yarn processing for reducing friction damage to the yarn being processed.

In textile yarn processing machines, such as twisters, spinning frames or the like, particularly two-for-one twisters, spindle assembly stations are provided for the processing of yarn and each includes a spindle assembly for carrying a package of yarn to be withdrawn and processed and which produces a rotating balloon of the yarn around the package as it is withdrawn therefrom, and a hollow balloon restrainer device having an inside wall surrounding the package of yarn and the balloon of yarn produced for contact by the rotating balloon of yarn to limit the size thereof during such yarn processing.

In such yarn processing machines, problems are presented with friction damage to the yarn being caused by contact of the rotating balloon of yarn with the inside wall of the balloon restrainer device. Additionally, yarn processing operations of this type produce considerable amounts of dust, lint, etc. which adhere to the inside wall of the balloon restrainer device increasing the coefficient of friction of the inside wall thus enhancing friction damage to the yarn being processed.

Heretofore, it has been proposed to provide special mechanical surface treatment for the inner walls of these balloon restrainer devices and it has been proposed to blow moist air or steam into the balloon restrainer device, axially along the inner face of the walls thereof in order to reduce the above described problems. However, in practice these provisions have proved ineffectual.

Additionally, it has been proposed, as disclosed in British Patent Specification No. 966,837, published June 30, 1965, to provide a balloon restrainer device having a double wall with the inner wall thereof, which comes into contact with the rotating balloon of yarn, being porous. A compressed gas or quickly vaporizing liquid is introduced between the double walls to emerge radially through the porous wall contacting the rotating balloon of yarn to provide a repellant action on the balloon of yarn so that the rotating balloon of yarn no longer comes into direct contact with the balloon restrainer wall.

However, this proposal requires a relatively complicated and expensive construction and the use of compressed gas or vaporizing liquid which increases the cost of such yarn processing apparatus and has other disadvantages.

SUMMARY OF THE INVENTION

Accordingly, it is the object of this invention to overcome the above problems with friction damage caused by contact of a rotating balloon of the yarn with the walls of a balloon restrainer device in a yarn processing apparatus and to eliminate the necessity of utilizing a double wall balloon restrainer device receiving compressed air or rapidly vaporizing liquid therein.

It has been found by this invention that the above object may be accomplished by providing, in a textile yarn processing machine, such as a twister, spinning frame or the like, having spindle assembly stations for the processing of yarn and each including a spindle assembly for carrying a package of yarn to be withdrawn and processed and which produces a rotating balloon of the yarn around the package as it is withdrawn therefrom, and a hollow balloon restrainer device having an inside wall surrounding the package of yarn and the balloon of yarn produced for contact by the rotating balloon of yarn to limit the size thereof during such yarn processing, the following improvement. An anti-friction means forming at least a portion of the inside wall of the balloon restrainer device for providing a reduced coefficient of friction surface for contact by the rotating balloon of yarn during yarn processing for reducing friction damage to the yarn being processed.

In a preferred form of the present invention, the anti-friction means is secured to and forms a coating on at least a portion of the inside wall of the balloon restrainer device and which may include either the portion only of the inner wall of the balloon restrainer device contacted by the rotating balloon of yarn during processing or the entire inner wall of the balloon restrainer device.

Preferably, the anti-friction means comprises a plastic based sinter material which is preferably a low-pressure polyethylene based material in the form of fine grains with almost spherical particles which have been subjected to a sinter process.

BRIEF DESCRIPTION OF THE DRAWINGS

Some of the objects and advantages of this invention having been stated, other objects and advantages will be seen, when taken in conjunction with the accompanying drawings, in which.

DESCRIPTION OF PREFERRED EMBODIMENTS

Figure 1:
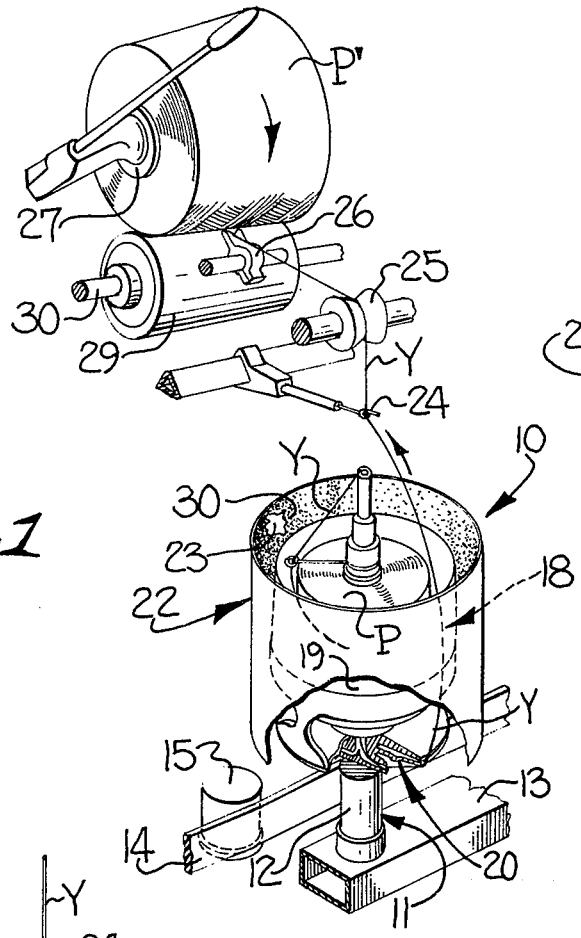
FIG. 1 is a perspective view, partly broken away, of one of the spindle assembly stations of a yarn processing machine in accordance with this invention.
Figure 4:
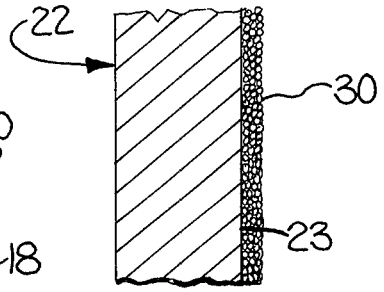
FIG. 4 is an enlarged, sectional, detail taken generally within the square 4 of FIG. 2.

Referring now to the drawings, there is illustrated in FIG. 1 a schematic, perspective view of a single spindle assembly station of a two-for-one twister yarn processing machine. It is to be understood that a plurality of these spindle assembly stations are provided on such twister machines in which the spindle assembly stations are arranged in side-by-side relationship in rows along the outsides of the machine. Also, similar spindle assembly stations could be utilized in other types of textile yarn processing machines. For purposes of this description, only one spindle assembly station for a two-for-one twister yarn processing machine will be described.

The spindle assembly station broadly includes a spindle assembly, generally indicated at 10, comprising a rotatably driven rotor mechanism, generally indicated at 11, which includes a whorl portion 12 suitably rotatably mounted on a portion of the twister machine frame 13 and rotated by a continuous, tangential, drive belt 14 in a manner well understood by those with ordinary skill in the art. Tension rolls 15 are associated with each spindle assembly 10 and are pivotally mounted for engaging and holding the drive belt 14 in tight driving engagement with whorl portion 12 for normal rotation of the rotor mechanism 11 of the spindle assembly 10 in a first position of the tension roll 15, as shown in FIG. 1. The tension roll 15 is also movable to a second position (not shown) for holding the drive belt 14 in loose engagement with the whorl portion 12 for allowing stopping of the rotor mechanism 11 of the spindle assembly 10 and for allowing slight rotation of the rotor mechanism 11 of the spindle assembly 10 for correct positioning thereof.

The spindle assembly 10 further includes a carrier mechanism 18 for carrying a package P of yarn Y and is rotatably mounted on the rotor mechansim 11 so that the rotor mechanism may rotate relative thereto while the carrier mechanism is maintained in stationary position. The carrier mechanism 18 includes a basket device 19 which surrounds the package P of yarn Y. Complete details of the rotor mechanism 11 and the carrier mechanism 18 are not illustrated and described herein inasmuch as these complete details are not necessary for an understanding of the present invention. During yarn processing or twisting, yarn Y is withdrawn from the package P and is threaded through the various mechanisms for twisting or processing of the yarn. The yarn Y emerges from the rotor mechanism 11 at the end of a channel 20 formed therein and forms a balloon of yarn Y around the package P and around the basket device 19.

For purposes of restraining the size of the thus formed balloon of yarn Y, a hollow balloon restrainer device 22 is mounted around the above described mechanisms of the spindle assembly 10 and around the rotating balloon of yarn Y and includes an inside wall 23 surrounding the rotating balloon of yarn Y for contact by the rotating balloon of yarn Y to limit the size thereof during such yarn processing.

The yarn Y is then led from the spindle assembly 10 through a pigtail guide 24, around a pre-take-up roller 25 and to a traversing device 26 from which it is wound onto a packaging roll 27 carrying a suitable bobbin or carrier for receiving the transversely wound yarn Y after it has been twisted or processed and for forming a package P′ of the twisted or processed yarn Y. The package roll 27 is driven or rotated by drive roll 29 frictionally contacting the surface of the package P′ of processed yarn Y on the package roll 27 for rotatably driving same. The drive roll 29 is driven by a shaft 30 in a manner well understood by those with ordinary skill in the art.

In accordance with the present invention and to reduce frictional damage to the yarn Y caused by contact of the rotating balloon of yarn Y with the inner wall 23 of the balloon restrainer device 22, there is provided anti-friction means, generally indicated at 30, forming at least a portion of the inside wall of the balloon restrainer device 22 for providing a reduced coefficient of friction surface, when compared with the surface of the inside wall of the balloon restrainer device 22, for contact by the rotating balloon of yarn Y during yarn processing.

Figure 2:
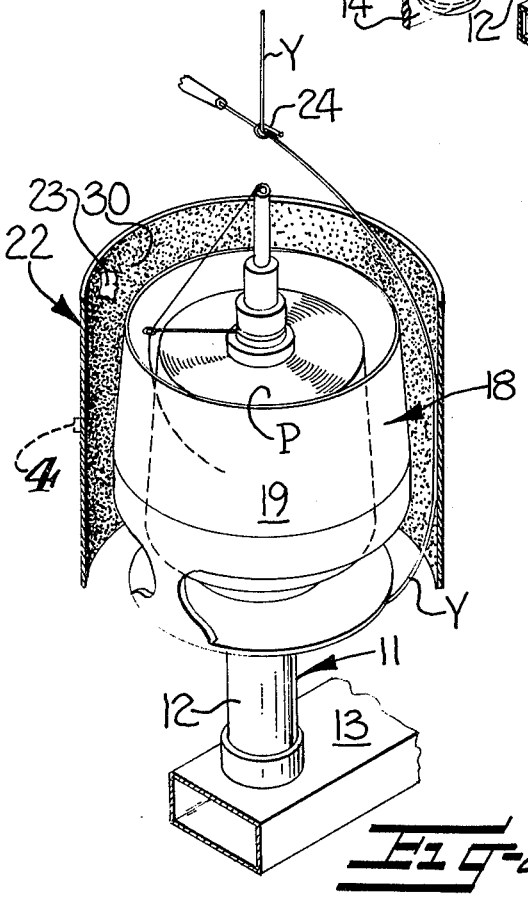
FIG. 2 is an enlarged perspective view, partially broken away, of the spindle assembly utilized in the station of FIG. 1 and utilizing one embodiment of the improvement of this invention therein.
Figure 3:
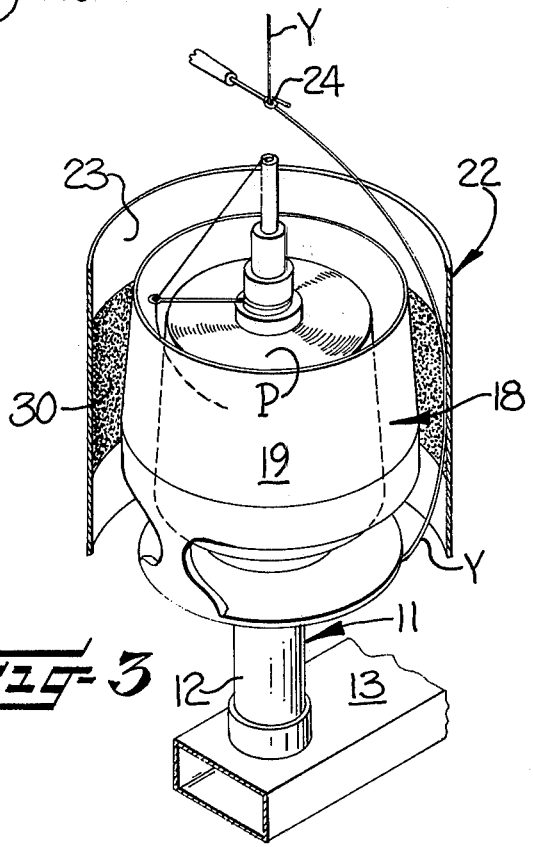
FIG. 3 is a view like FIG. 2 illustrating another embodiment of the improvement in accordance with this invention.

This anti-friction means is preferably secured to and forms a coating on at least a portion of the inside wall 23 of the balloon restrainer device 22. As illustrated in FIG. 3, the anti-friction means 30 comprises the portion only of the inner wall 23 of the balloon restrainer device 22 contacted by the rotating balloon of yarn Y during processing or a medial portion thereof extending around the entire inside circumference thereof. On the other hand, as illustrated in FIG. 2, the anti-friction means 30 may comprise the entire inner wall of the balloon restrainer device 22.

The anti-frictional means preferably comprises a plastic based sinter material of which low-pressure polyethylene based material in the form of fine grains with almost spherical particles which have been subjected to a sinter process has been found to be particularly applicable. This low-pressure polyethylene based sinter material may have a density of 0.61–0.66g/cm$^3$ and a perocity of 27 – 35 percent. This type of material significantly reduces the coefficient of friction of the surface contacted by the rotating balloon of yarn Y being processed and eliminates any appreciable build up of particles of fiber, size, dust, finishing agents, etc. which are conventionally formed on the yarn contacting surface of balloon restrainer devices. This sintered material has a capillary action and, if it is desired to treat the yarn with a finisher or other agent, the sinter material of the anti-friction means 30 may be impregnated with the appropriate agents which may further enhance the anti-friction properties thereof.

Although the anti-friction means 30 has been shown in the drawings and described herein as a coating on the inside wall 23 of the balloon restrainer device 22, the balloon restrainer device 22 could be formed or a portion thereof could be formed of the anti-friction material.

Thus it may be seen, that this invention has provided an improved anti-friction means for use on the inside walls of a balloon restrainer device in a textile yarn processing machine for overcoming previous problems of friction damage to yarn being processed by providing a reduced coefficient of friction surface for contact with the rotating balloon of yarn during yarn processing.

In the drawings and specification, there have been set forth preferred embodiments of this invention, and although specific terms are employed, they are used in a generic and descriptive sense only and not for purposes of limitation.

What is claimed is:

1. In a textile yarn processing machine, such as a twister, spinning frame or the like, having spindle assembly stations for the processing of yarn and each including a spindle assembly for carrying a package of yarn to be withdrawn and processed and which produces a rotating balloon of the yarn around the package as it is withdrawn therefrom, and a hollow balloon restrainer device having an inside wall surrounding the package of yarn and the balloon of yarn produced for contact by the rotating balloon of yarn to limit the size thereof during such yarn processing; the improvement of:

anti-friction means secured to and forming a coating on at least a portion of said inside wall of said balloon restrainer device for providing a reduced coefficient of friction surface, when compared with the surface of said inside wall, for contact by the rotating balloon of yarn during yarn processing for reducing friction damage to the yarn being processed, said anti-friction means comprising low-pressure polyethlyene based material in the form of fine grains with almost spherical particles which have been subjected to a sinter process.

2. In a textile yarn processing machine, such as a twister, spinning frame or the like, having spindle assembly stations for the processing of yarn and each including a spindle assembly for carrying a package of yarn to be withdrawn and processed and which produced a rotating balloon of the yarn around the package as it is withdrawn therefrom, and a hollow balloon restrainer device having an inside wall surrounding the package of yarn and the balloon of yarn produced for contact by the balloon of yarn to limit the size thereof during such yarn processing; the improvement of:

anti-friction means secured to and forming a coating on only those portions of said inner wall of said balloon restrainer device contacted by the rotating balloon of yarn during such processing for providing a reduced coefficient of friction surface, when compared with the surface of said inside wall, for reducing friction damage to the yarn being processed.

3. In a textile yarn processing machine, as set forth in claim 1, in which said anti-friction means comprises means secured to and forming a coating on the entire inner wall of said balloon restrainer device.

4. In a textile yarn processing machine, such as a twister, spinning frame or the like, having spindle assembly stations for the processing of yarn and each including a spindle assembly for carrying a package of yarn to be withdrawn and processed and which produces a rotating balloon of the yarn around the package as it is withdrawn therefrom, and a hollow balloon restrainer device having an inside wall surrounding the package of yarn and the balloon of yarn produced for contact by the rotating balloon of yarn to limit the size thereof during such yarn processing; the improvement of:

anti-friction means forming at least a portion of said inside wall of said balloon restrainer device and comprising a plastic based sinter material for providing a reduced coefficient of friction surface for contact by the rotating balloon of yarn during yarn processing for reducing friction damage to the yarn being processed, said plastic based sinter material comprising low-pressure polyethylene based material in the form of fine grains with almost spherical particles which have been subjected to a sinter process.

5. In a textile yarn processing machine, such as a twister, spinning frame or the like, having spindle assembly stations for the processing of yarn and each including a spindle assembly for carrying a package of yarn to be withdrawn and processed and which produces a rotating balloon of the yarn around the package as it is withdrawn therefrom, and a hollow balloon restrainer device having an inside wall surrounding the package of yarn and the balloon of yarn produced for contact by the rotating balloon of yarn to limit the size thereof during such yarn processing; the improvement of:

anti-friction means forming a portion only of said inner wall of said balloon restrainer device contacted by the rotating balloon of yarn during processing and comprising a plastic based sinter material for providing a reduced coefficient of friction surface for reducing friction damage to the yarn being processed.

6. In a textile yarn processing machine, as set forth in claim 4, in which said anti-friction means comprises the entire inner wall of said balloon restrainer device.

* * * * *